US007786939B2

(12) United States Patent
Lee

(10) Patent No.: US 7,786,939 B2
(45) Date of Patent: Aug. 31, 2010

(54) MOBILE TERMINAL EQUIPMENT AND ANTENNA THEREOF

(75) Inventor: Hyo Jin Lee, Seoul (KR)

(73) Assignee: LG Telecom, Ltd., Seoul (KR)

( * ) Notice: Subject to any disclaimer, the term of this patent is extended or adjusted under 35 U.S.C. 154(b) by 675 days.

(21) Appl. No.: 10/589,824

(22) PCT Filed: Feb. 21, 2005

(86) PCT No.: PCT/KR2005/000470

§ 371 (c)(1),
(2), (4) Date: Apr. 24, 2007

(87) PCT Pub. No.: WO2005/081418

PCT Pub. Date: Sep. 1, 2005

(65) Prior Publication Data

US 2008/0042918 A1 Feb. 21, 2008

(30) Foreign Application Priority Data

Feb. 20, 2004 (KR) ..... 10-2004-0011584

(51) Int. Cl.
*H01Q 1/32* (2006.01)

(52) U.S. Cl. ..... 343/702

(58) Field of Classification Search ..... 343/702, 343/895, 900–901
See application file for complete search history.

(56) References Cited

U.S. PATENT DOCUMENTS

| | | | | |
|---|---|---|---|---|
| 5,969,684 | A * | 10/1999 | Oh et al. | 343/702 |
| 6,069,592 | A * | 5/2000 | Wass | 343/895 |
| 6,137,445 | A | 10/2000 | Ha et al. | |
| 6,147,653 | A | 11/2000 | Wallace et al. | |
| 6,239,755 | B1 | 5/2001 | Klemens et al. | |
| 6,490,435 | B1 | 12/2002 | Ma et al. | |
| 7,038,635 | B2 * | 5/2006 | Fukushima et al. | 343/895 |
| 7,330,154 | B2 * | 2/2008 | Kanazawa | 343/702 |
| 7,495,619 | B2 * | 2/2009 | Fossett | 343/702 |

* cited by examiner

*Primary Examiner*—Huedung Mancuso
(74) *Attorney, Agent, or Firm*—Birch, Stewart, Kolasch & Birch, LLP

(57) ABSTRACT

The present invention relates to a mobile terminal and an antenna thereof of which the radiation pattern is not distorted regardless of the length of the mobile terminal. The mobile terminal includes a terminal body; an antenna connected to a high frequency signal source within the terminal body; and a grounding means connected to a ground voltage source within the terminal body.

10 Claims, 11 Drawing Sheets

MOBILE TERMINAL EQUIPMENT AND ANTENNA THEREOF

TECHNICAL FIELD

The present invention relates to a mobile terminal that is adaptive for preventing an antenna radiation pattern from being distorted regardless of the length of the mobile terminal, and an antenna thereof.

BACKGROUND ART

In a wireless communication network such as a mobile network or a wireless local loop WLL, a base station is installed between a mobile switching center and a mobile terminal of a subscriber, and a wireless signal is exchanged between the base station and the mobile terminal of the subscriber. An antenna is installed in the mobile terminal and the base station for transmitting/receiving the wireless signal.

The antenna of the mobile terminal, as shown in FIG. 1, is conventionally composed in a method where a high frequency signal source 13 is connected between a monopole antenna 12 and a grounded terminal body 11. The monopole antenna 12 applied to the mobile terminal is classified into a whip antenna and a helical antenna.

A whip antenna 15, as in FIG. 2, is designed to have a length of λ/4 in order to maximize its transmission/reception efficiency, if a frequency wavelength is λ. And, the helical antenna 16 has its length of λ/4 in relation to an electric wave and is designed to be twisted in a screw shape in order to shorten the length. The whip antenna 15 has a higher gain than the helical antenna 16, but is designed to be extended because of the appearance due to the length, and designed to be jointly used together with the helical antenna 16. The helical antenna 16 is inserted into and fixed in a housing 14 that is installed at one side of the upper end of the terminal body 11.

In case that the ground-plane of the monopole antenna 12 is a perfect ground-plane, an image is displayed in a grounding opposite direction. The antenna of the mobile terminal is operated like a dipole antenna by the image displayed in the grounding opposite direction and the monopole antenna 12. However, the ground-plane of the mobile terminal is conventionally not formed ideally, thus the ground-plane affects the performance of the antenna of the mobile terminal.

The influence that is caused to the antenna by the ground-plane becomes different in accordance with the length of the mobile terminal. The antenna of the mobile terminal is operated at a maximum performance, when the length L1 of the monopole antenna 12 is λ/4 and the length L2 of the terminal body 11 is λ/4, as in FIG. 1.

The body length L2 of the mobile terminal is conventionally is designed to be λ/4 of the wavelength which is used in a cellular method. Accordingly, the antenna of the mobile terminal operates with the best transmission/reception efficiency when it is operated on a cellular basis because the length of the mobile terminal body 11 is optimized to be λ/4. However, if the mobile terminal is used in a personal communication service PCS method, the wavelength of the electric wave corresponds to half the cellular method in the PCS of which the usage frequency is approximately two folds higher than the cellular method, thus the length of the mobile terminal body 11 is λ/2. Because of this, the current distributed in the mobile terminal body 11 becomes relatively larger than the current radiated in the monopole antenna 12. As a result, in the PCS, as in FIG. 3, an antenna radiation pattern 20 is tilted downward, i.e., toward the terminal body 11. Accordingly, if the mobile terminal designed on the basis of the cellular method is applied to the PCS method, the antenna radiation pattern 20 is reduced in the direction of −90° to +90° as in FIG. 3. This phenomenon acts as a cause that reduces the transmission/reception efficiency of the mobile terminal when considering that the base station antenna is located on the top of the terminal.

DISCLOSURE OF INVENTION

Accordingly, it is an object of the present invention to provide a mobile terminal that is adaptive for preventing an antenna radiation pattern from being distorted in an upper part regardless of the length of the mobile terminal, and an antenna thereof.

It is another object of the present invention to provide a mobile terminal that is adaptive for increasing the transmission/reception efficiency of a mobile terminal, and an antenna thereof.

In order to achieve these and other objects of the invention, a mobile terminal and an antenna thereof according to an aspect of the present invention includes a separate grounding means having a length of λ/4 in relation to the waveform λ of an electric wave.

BRIEF DESCRIPTION OF DRAWINGS

These and other objects of the invention will be apparent from the following detailed description of the embodiments of the present invention with reference to the accompanying drawings, in which.

BEST MODE FOR CARRYING OUT THE INVENTION

Reference will now be made in detail to the preferred embodiments of the present invention, examples of which are illustrated in the accompanying drawings.

With reference to FIGS. 4 to 11, embodiments of the present invention will be explained as follows.

Figure 4:
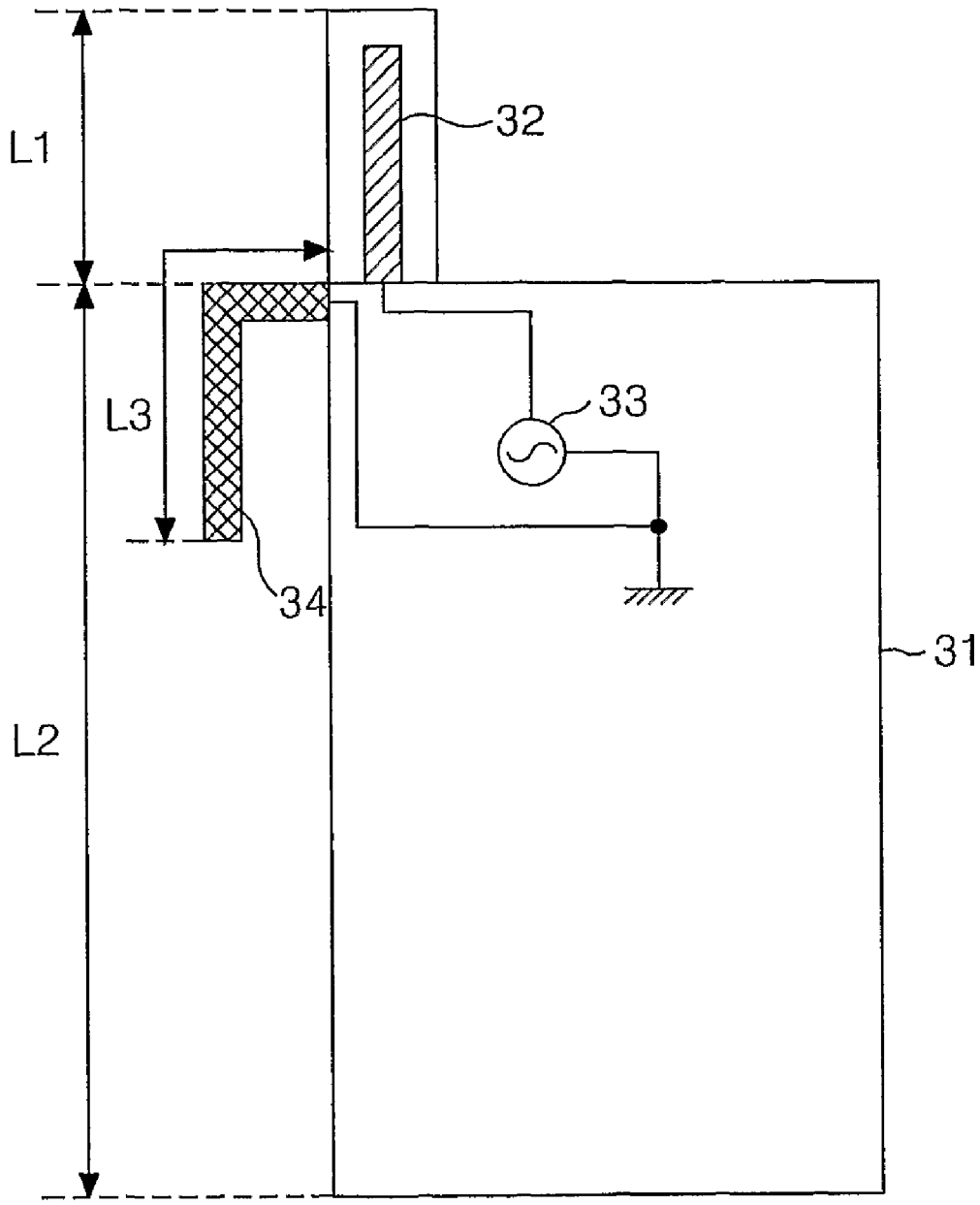
FIG. 4 is a diagram representing a mobile terminal and an antenna thereof according to a first embodiment of the present invention.
Figure 5:
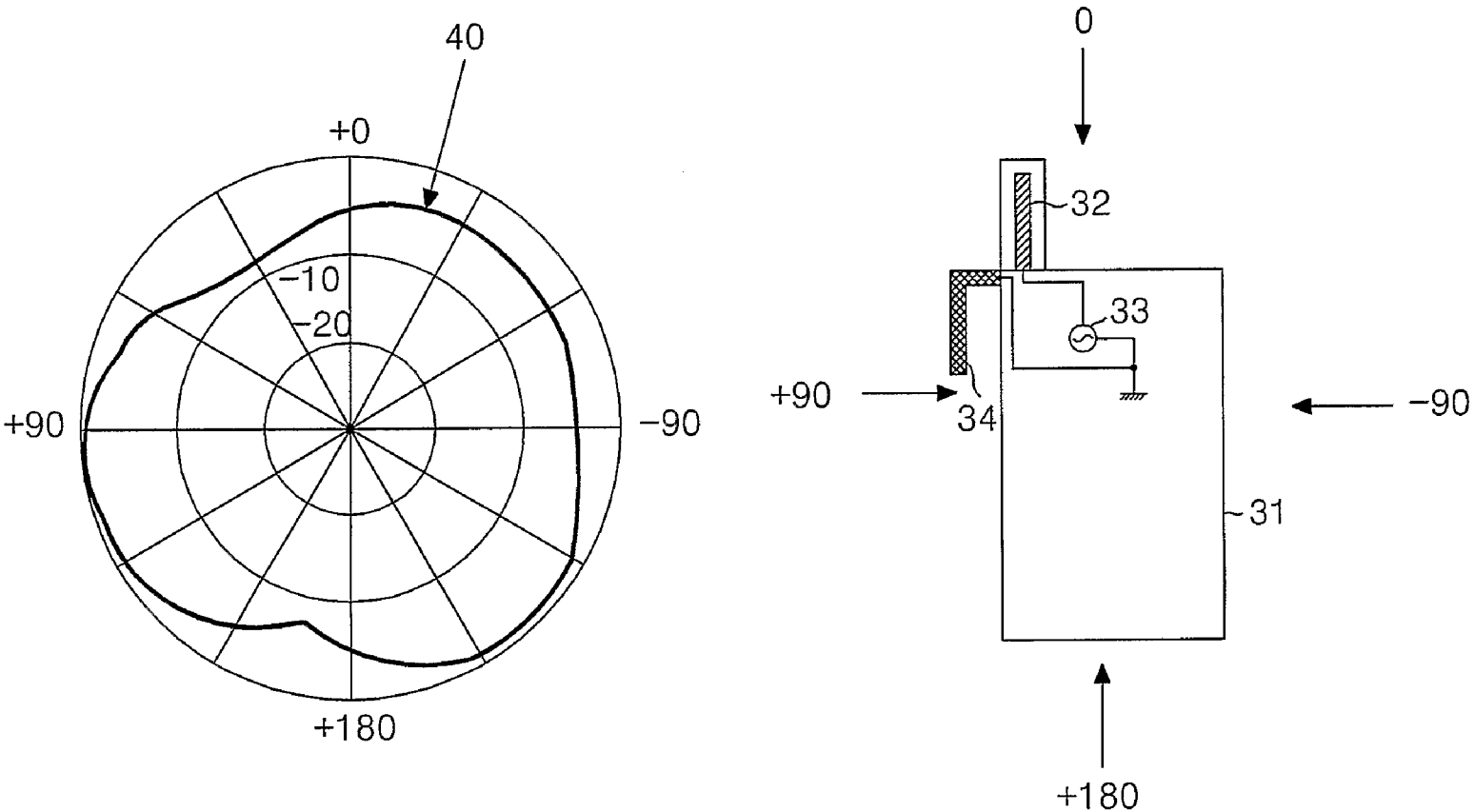
FIG. 5 is a diagram representing a vertical radiation pattern of the antenna shown in FIG. 4.

Referring to FIGS. 4 and 5, a mobile terminal according to a first embodiment of the present invention includes a monopole antenna 32 installed at one side of an upper end of a terminal body 31, and a grounding wing 34 connected to a ground voltage source GND in the terminal body 31.

A display means such as a liquid crystal display LCD and/or an electro-luminescence EL and an input means such as a key pad and a touch panel are installed in the terminal body 31. Further, a power circuit and a signal transmission/reception circuit inclusive of the display means, the input means and a high frequency signal source 33 are installed in the terminal body 31.

The monopole antenna 32 is inserted into a housing that is installed at one side of an upper end of the terminal body 31, and a high frequency signal power is supplied from a high frequency signal source 33. The high frequency signal source 33 is connected between the monopole antenna 32 and a ground voltage source. The length L1 of the monopole antenna 32 is λ/4 in relation to the wavelength λ of an electric wave, and it can be realized in a helical antenna in order to reduce the physical length.

The grounding wing 34 is connected to the ground voltage source GND within the terminal body 31 to act as a grounding electrode of the antenna. The grounding wing 34 is manufactured of a flexible metal material or in a wire shape where a plurality of metal pieces are linked in a chain shape to have flexibility, and is connected to one side of the terminal body 31. The length L3 of the grounding wing 34 is λ/4 in relation to the wavelength λ/4 of an electric wave, and it can be different in accordance with the transmission/reception frequency of the electric wave and the shape of the mobile terminal.

Each length of the monopole antenna 32 and the grounding wing 34 is λ/4 in relation to the length λ of an electric wave, thus it substantially operates in the same manner as the dipole antenna.

Figure 1:
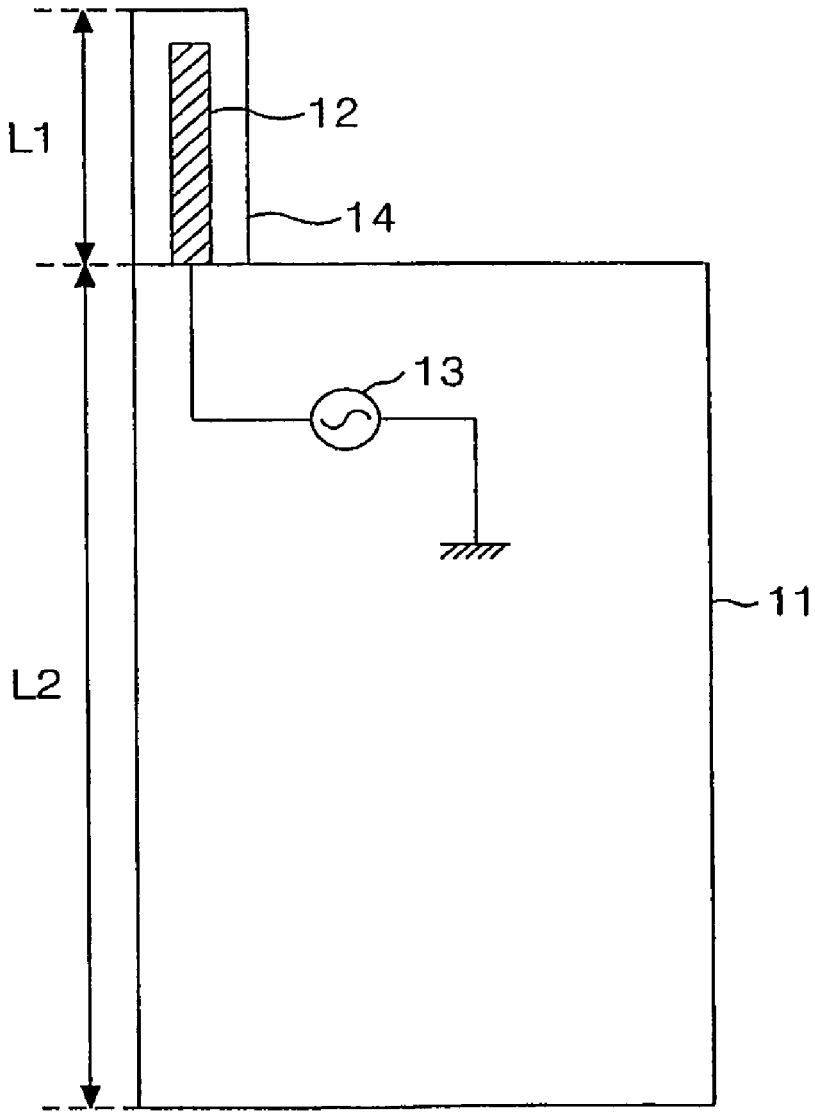
Prior Art FIG. 1
FIG. 1 is a diagram representing a conventional mobile terminal.
Figure 2:
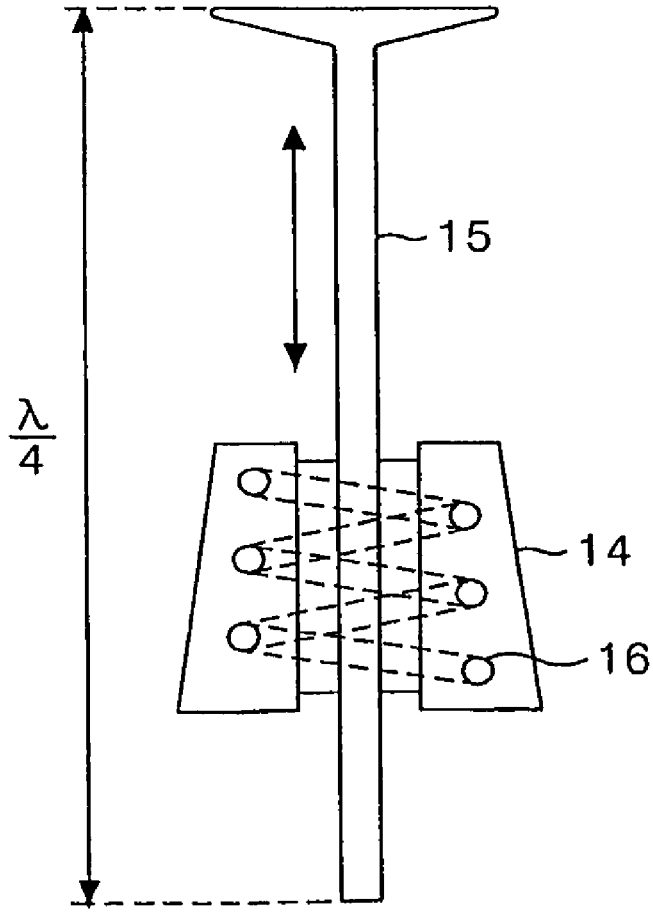
Prior Art FIG. 2
FIG. 2 is a sectional diagram representing a whip antenna and a helical antenna of FIG. 1 in detail.
Figure 3:
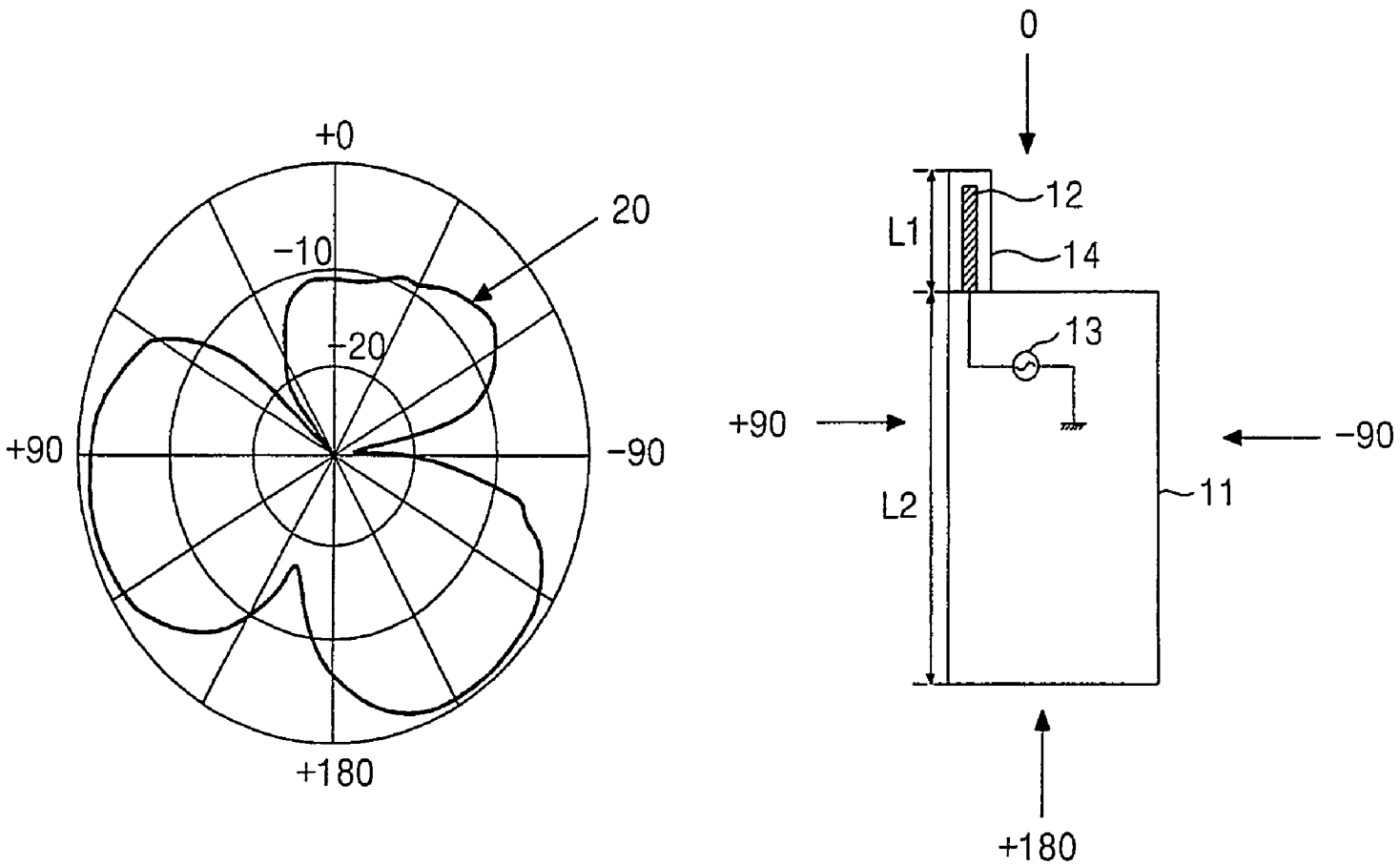
Prior Art FIG. 3
FIG. 3 is a diagram representing a vertical radiation pattern of an antenna shown in FIG. 1.

As a result of experimenting an antenna characteristic in a electric wave frequency range of PCS in relation to the mobile terminal as shown in FIG. 4, the antenna of the mobile terminal as in FIG. 5 does not have a null point in the radiation pattern in relation to the entire azimuth. According to this experiment, the distribution of the current flowing in the monopole antenna 32 and the distribution of the current flowing in the grounding opposite direction are made to be uniform by the grounding wing 34, thus even though the mobile terminal is used in the PCS base, the antenna radiation pattern 40 is known to be relatively uniform in the entire azimuth. Accordingly, the mobile terminal as in FIG. 3 might be able to increase transmission/reception sensitivity in the entire azimuth even in any usage frequency regardless of the length of the mobile terminal.

Figure 6:
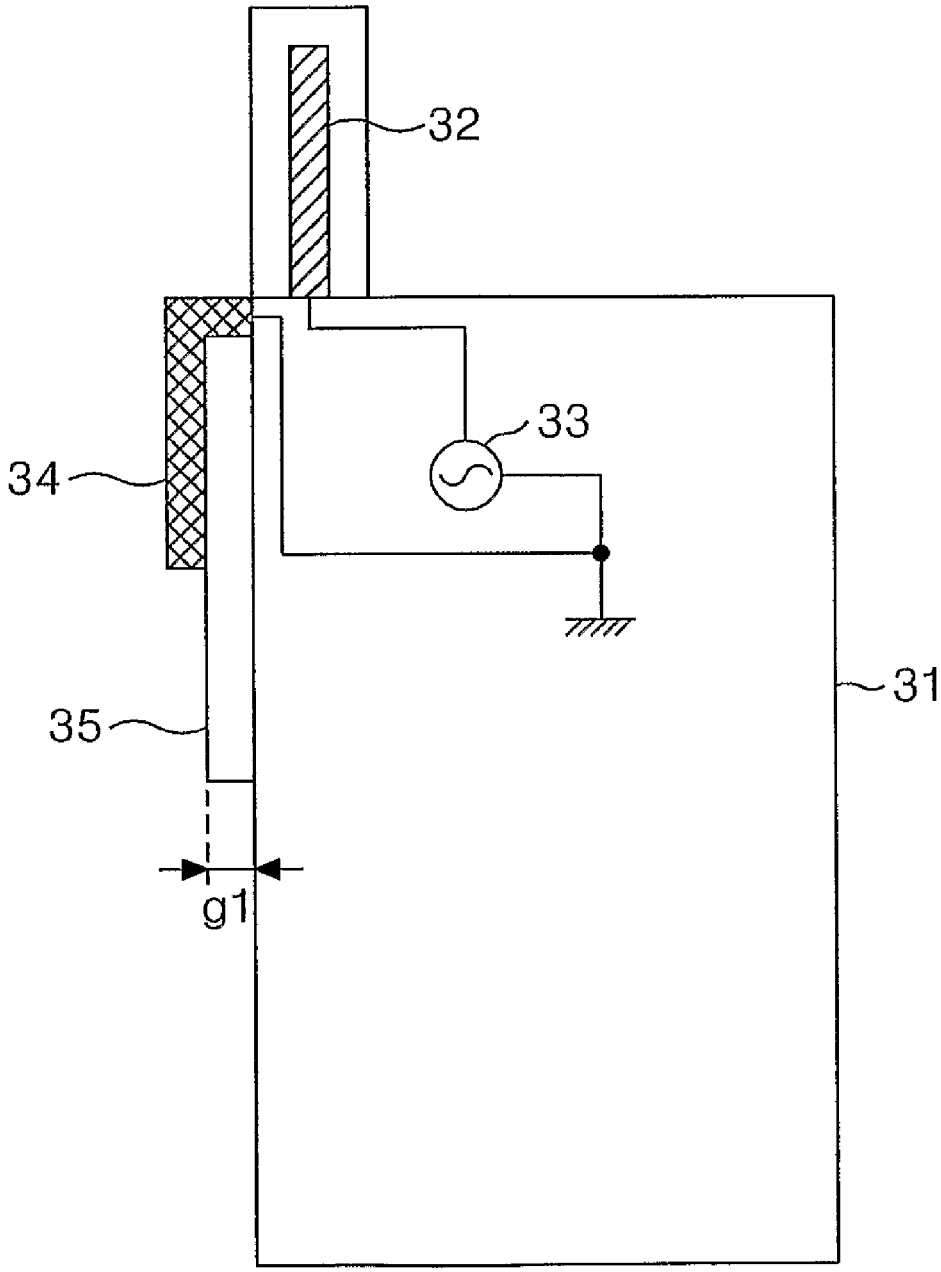
FIG. 6 is a diagram representing a mobile terminal and an antenna thereof according to a second embodiment of the present invention.

FIG. 6 represents a mobile terminal and an antenna thereof according to a second embodiment of the present invention. In FIG. 6, for the same components as the mobile terminal shown in FIG. 5, the same reference numeral is given and the detail description thereof is omitted.

Referring to FIG. 6, the mobile terminal according to the second embodiment of the present invention includes a dielectric substance formed between the grounding wing 34 and the terminal body 31.

The dielectric substance 35 has a fixed dielectric constant, and plays a role of reducing a gap G1 between the terminal body 31 and the grounding wing 34 by increasing the degree of insulation between the terminal body 31 and the grounding wing 34. The higher the dielectric constant of the dielectric substance 35, the smaller the gap G1 between the terminal body 31 and the grounding wing 34. The dielectric constant of the dielectric substance 35 is desirable to be about 3~40.

Figure 7:
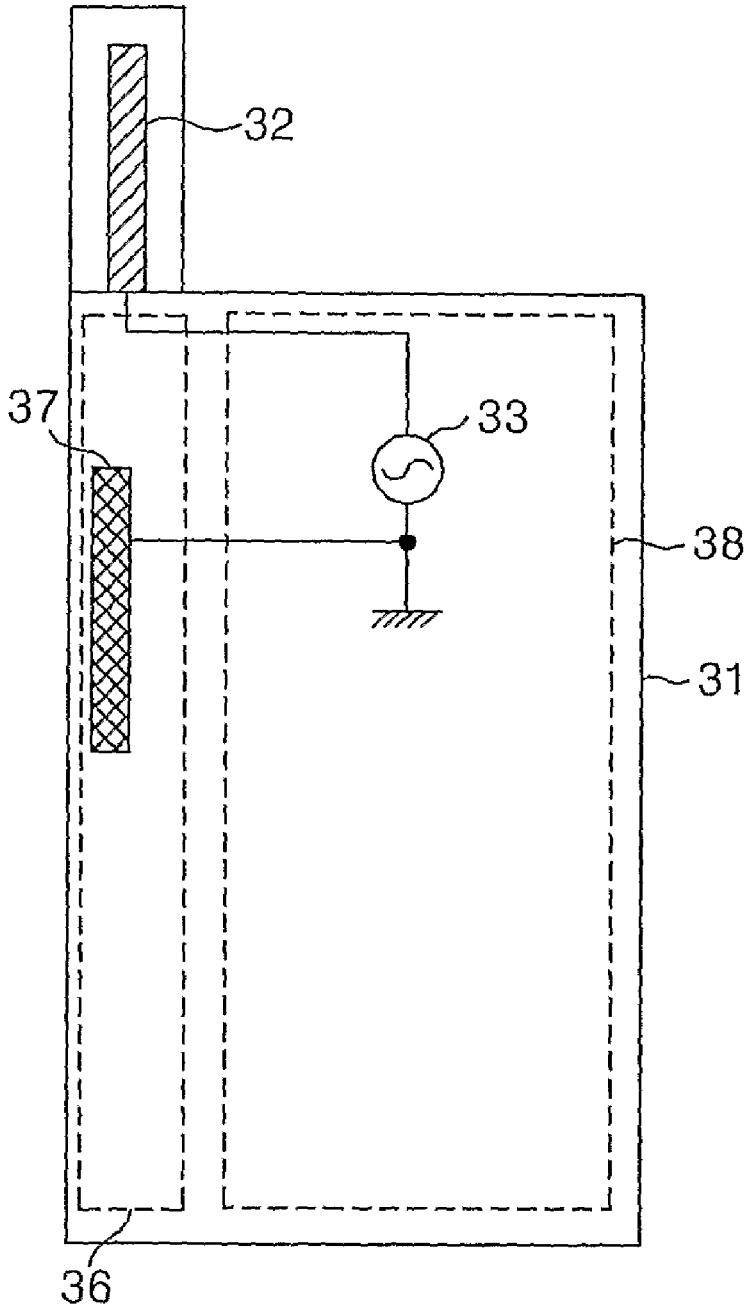
FIG. 7 is a diagram representing a mobile terminal and an antenna thereof according to a third embodiment of the present invention.

On the other hand, the grounding wing 34 might be exposed to the outside of the terminal body 31 as in FIG. 4, but it might be formed within the terminal body 31 as FIG. 7.

Referring to FIG. 7, a mobile terminal according to a third embodiment of the present invention includes a grounding wing 37 that is embedded within the terminal body 31.

The grounding wing 37 is connected to a ground voltage source GND within the terminal body 31. The grounding wing 34 is formed as a metal thin film within a separate space 36 where there is no metal shield 35 for intercepting an electro magnetic interference EMI. A length L3 of the grounding wing 37 is λ/4 in relation to the waveform λ of an electric wave, and it can be different in accordance with the transmission/reception frequency of an electric wave and the shape of the mobile terminal.

An EMI intercepting metal shield 38 formed in the inner surface of the housing of the terminal body 31 is formed at a printed circuit board PCB part on which a high frequency signal source 33, a ground voltage source GND and various drive circuits are mounted, except for a separate space 36 where the grounding wing 37 is formed within the terminal body 31.

Figure 8:
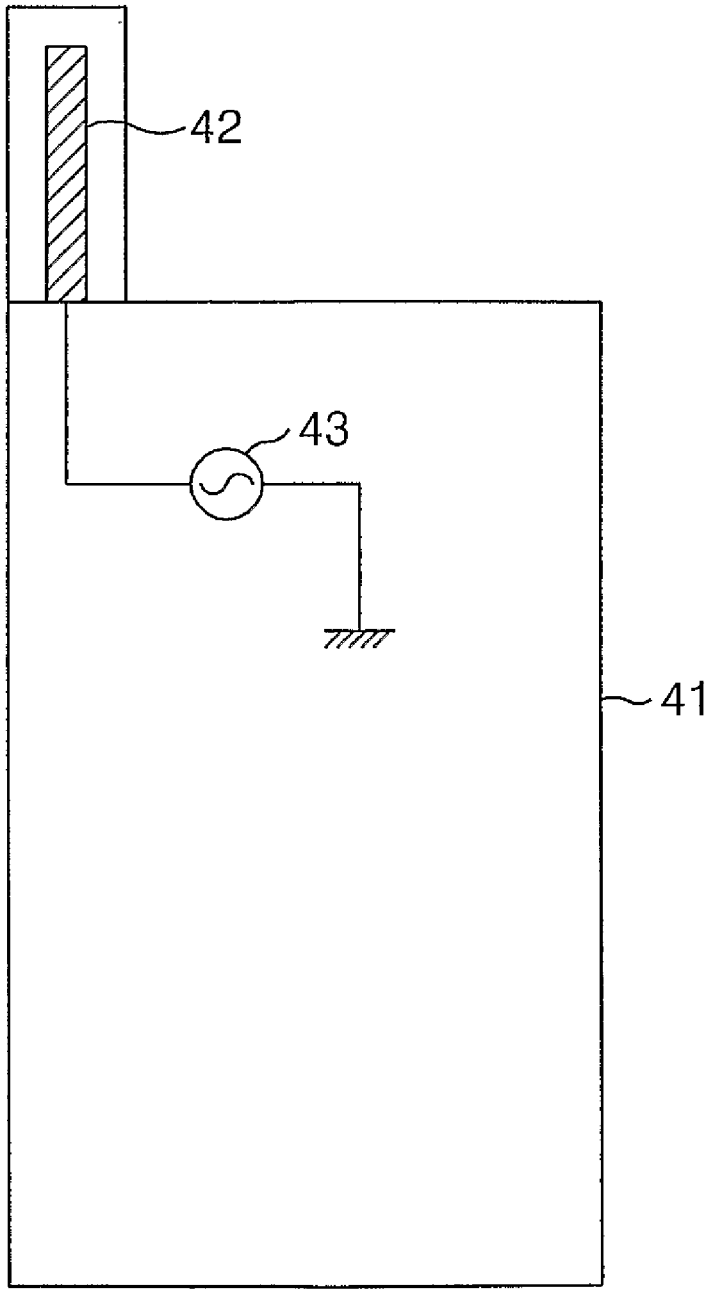
FIGS. 8 and 9 are diagrams representing a mobile terminal and an antenna thereof according to a fourth embodiment of the present invention.
Figure 9:
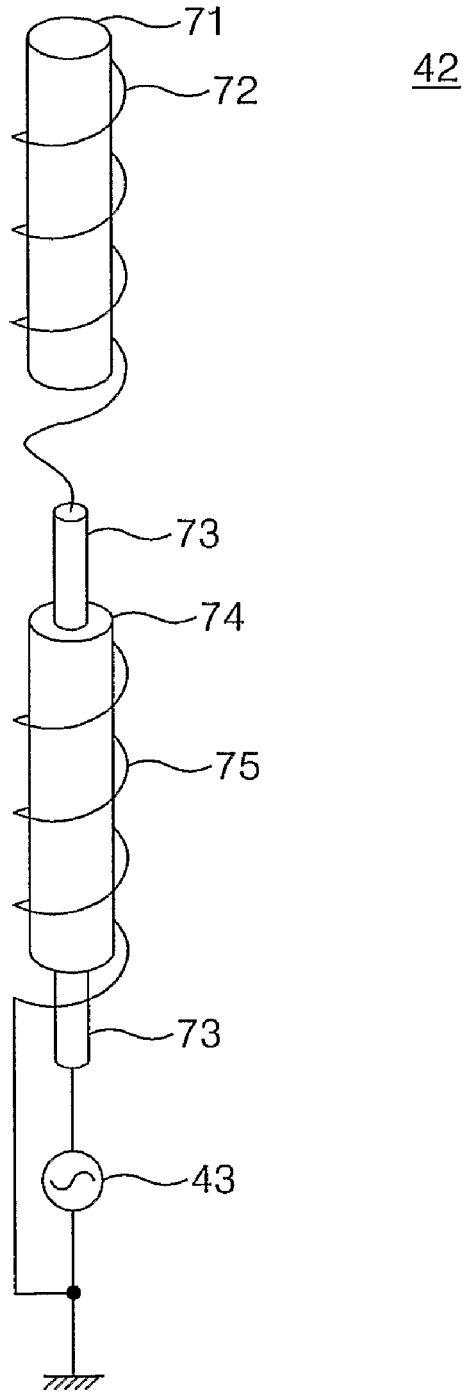

FIGS. 8 and 9 represent a mobile terminal and an antenna thereof according to a fourth embodiment of the present invention.

Referring to FIGS. 8 and 9, the antenna of the mobile terminal according to the fourth embodiment of the present invention includes an upper coil 72 wound in an upper core 71, and a lower coil 75 wound in a lower core 74.

The twisted whole length of the upper coil 72 is λ/4 in relation to the waveform λ of an electric wave, thus the upper coil 72 acts as a monopole antenna. The upper coil 72 is connected to a conductive inner core 73 that penetrates the lower core 74, and it receives a high frequency signal power from a high frequency signal source 43 through the conductive inner core 73. The twisted whole length of the lower coil 75 is λ/4 in relation to the waveform λ of an electric wave. The lower coil 75 is wound on the surface of the lower core 74 insulated from the conductive inner core 73, and one end thereof is connected to the ground voltage source within the terminal body 41 and the other end acts as a ground wire that is not connected to any power source.

The antenna 42 might increase the transmission/reception sensitivity of the antenna in relation to the entire azimuth even in any usage frequency environment regardless of the length of the terminal body 41 by the ground wire, i.e., the lower coil 75, having the length of λ/4 in relation to the waveform λ of an electric wave.

Figure 10:
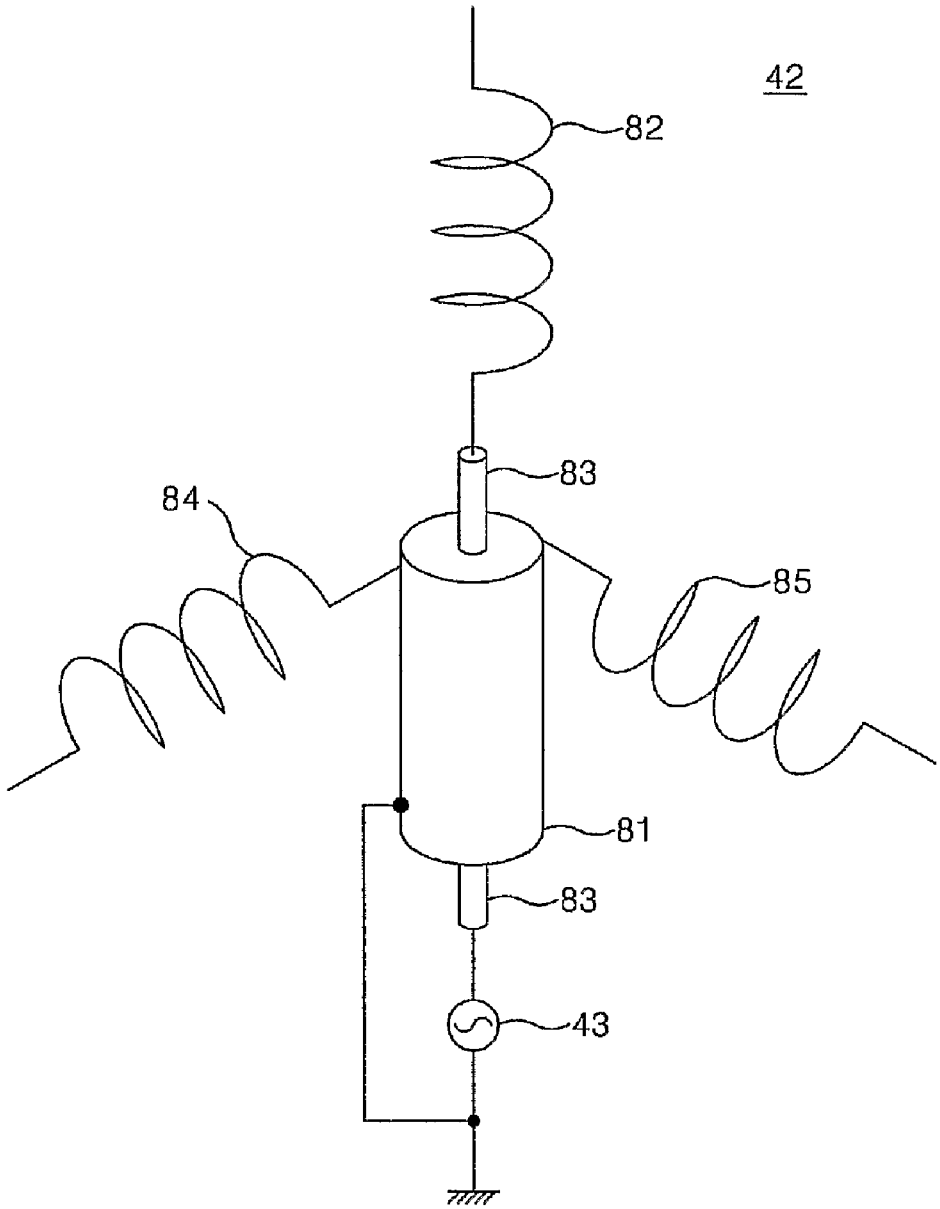
FIG. 10 is a diagram representing a mobile terminal and an antenna thereof according to a fifth embodiment of the present invention.

FIG. 10 represents an antenna of a mobile terminal according to a fifth embodiment of the present invention. The antenna of FIG. 10 might be applied as the antenna of the mobile terminal of FIG. 8.

Referring to FIGS. 8 and 10, the antenna 42 of the mobile terminal affording to the fifth embodiment of the present invention includes an upper coil 82 receiving a high frequency signal power, and at least one lower coil 84, 85 of which one side is grounded.

Further, the antenna 42 of the mobile terminal has a conductive inner core 83 inserted and further includes a core 81 having a conductive surface. One end of the conductive inner core 83 is connected to one end of the upper coil 82, and the other end of the conductive inner core 83 is connected to a high frequency signal source 43. One end of the lower coils 84, 85 and the ground voltage source are connected to the surface of the core 81.

The twisted whole length of the upper coil 82 is λ/4 in relation to the waveform λ of an electric wave, thus the upper coil 82 acts as a monopole antenna. The upper coil 82 receives a high frequency signal power from a high frequency signal source 43 through the conductive inner core 83. The twisted whole length of the lower coils 84, 85 is λ/4 in relation to the waveform λ of an electric wave, and the lower coils 84, 85 act as a ground wire that is connected to the ground voltage source through the conductive surface of the core 81.

The antenna 42 might increase the transmission/reception sensitivity of the antenna in relation to the entire azimuth even in any usage frequency environment regardless of the length of the terminal body 41 by the ground wire, i.e., the lower coil 75, having the length of λ/4 in relation to the waveform λ of an electric wave.

Figure 11:
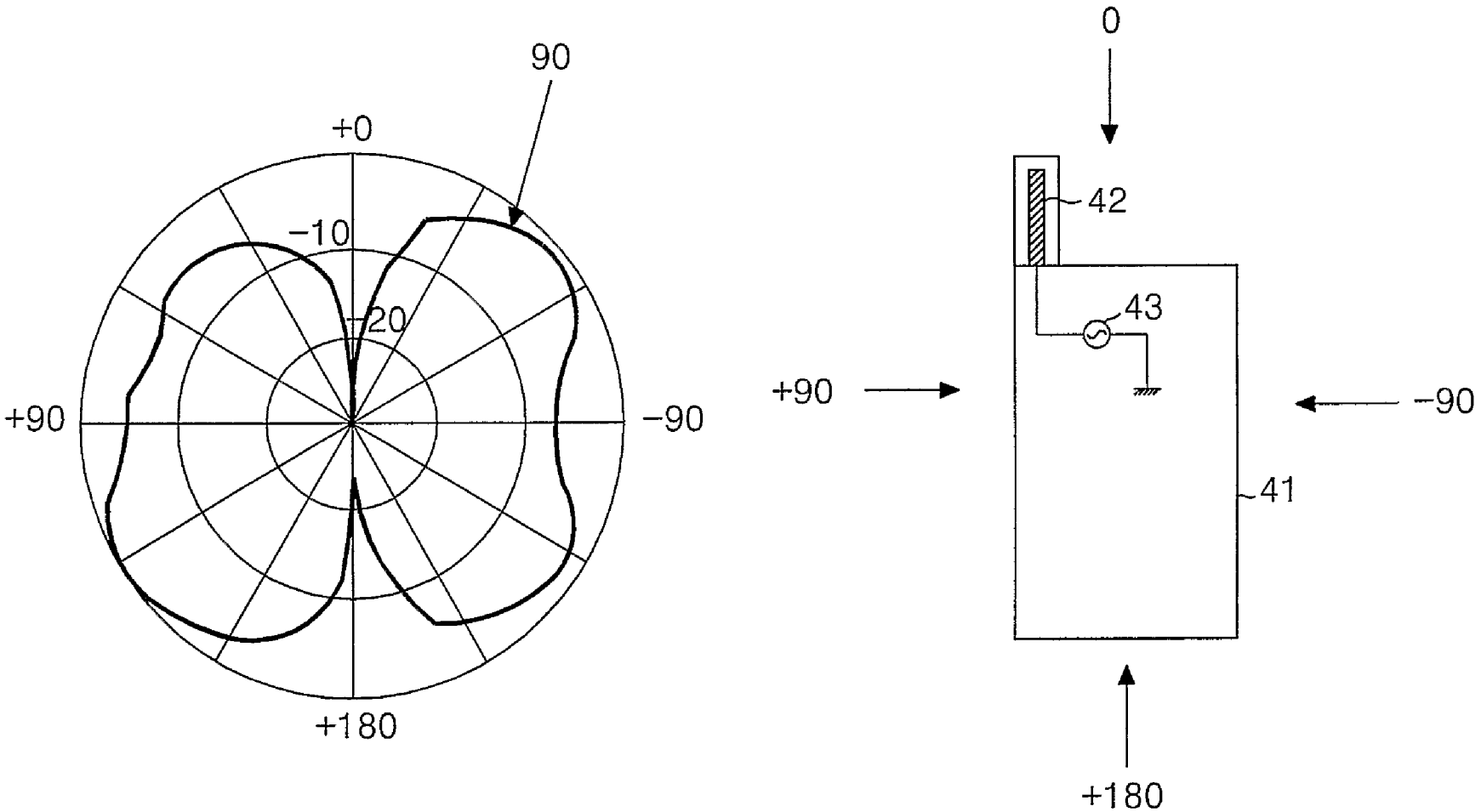
FIG. 11 is a diagram representing a vertical radiation pattern of the antenna shown in FIG. 10.

FIG. 11 applies the antenna 42 as in FIG. 10 in relation to the mobile terminal as in FIG. 8 and is an antenna radiation pattern obtained at the antenna's characteristic experiment in the electric wave frequency range of the PCS. According to the experiment result, as it can be known in FIG. 11, the antenna radiation pattern obtained in the antenna of FIG. 10 is shown to be equal to the antenna characteristic of the cellular range. That is, the antenna 42 as in FIG. 10 operates as an ideal dipole antenna characteristic even in the PCS base. Further, according to the result of measuring a receiving signal strength in relation to the mobile terminal to which the antenna 42 as in FIG. 10 is applied, a receiving gain is measured to be high. Particularly, as a result of experiment in a state that the mobile terminal is held by a hand and adhered closely to a head in the same manner as the real telephone conversation environment of the mobile terminal, the average receiving gain thereof is measured to be higher than the average of 5 dB when compared with the mobile terminal other than the same kinds.

The mobile terminal and the antenna thereof according to the embodiment of the present invention might prevent the distortion of the antenna radiation pattern in any usage frequency environment regardless of the length of the mobile terminal by use of the separate grounding means having the length of λ/4 in relation to the waveform λ of the electric wave. Further, the mobile terminal and the antenna thereof according to the embodiment of the present invention might increase the transmission/reception efficiency of the mobile terminal by applying the grounding means to the mobile terminal Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

The invention claimed is:

1. A mobile terminal, comprising:

a terminal body;

an antenna connected to a high frequency signal source within the terminal body; and a grounding means connected to a ground voltage source within the terminal body, and wherein the antenna includes:

an antenna coil to receive a high frequency signal power from the high frequency signal source;

a conductive inner core electrically connected to the high frequency signal source and the antenna coil;

a core through which a conductive inner core penetrates, of which the surface is insulated from the conductive inner core, and which has a conductive surface electrically connected to the ground voltage source; and at least one grounding coil connected to the ground voltage source through the conductive surface of the core.

2. The mobile terminal according to claim 1, wherein the antenna is a monopole antenna.

3. The mobile terminal according to claim 1, wherein the grounding means is exposed to the outside of the terminal body.

4. The mobile terminal according to claim 1, wherein the grounding means is embedded within the terminal body.

5. The mobile terminal according to claim 4, wherein an electro magnetic interference EMI intercepting metal shield is formed in a space other than a space where the grounding means is formed in the inside of the terminal body.

6. The mobile terminal according to claim 1, wherein each linear length of the antenna coil and the grounding coil is ¼ of the wavelength of the electric wave.

7. An antenna of a mobile terminal, comprising:

an antenna coil to receive a high frequency signal; and a grounding means having a length of ¼ of a wavelength of an electric wave;

a first core on which the antenna coil is wound;

a conductive inner core electrically connected to one end of the antenna coil to receive the high frequency signal; and a second core through which the conductive inner core penetrates and of which the surface is insulated from the conductive inner core, and wherein the at least one grounding coil is wound on the surface of the second core.

8. The antenna of a mobile terminal according to claim 7, further comprising:

a core through which the conductive inner core penetrates, which remains to be insulated from the conductive inner core and which has a conductive surface connected to the ground voltage source, and wherein one end of the at least one grounding coil is connected to the surface of the core.

9. An antenna of a mobile terminal, comprising:

an antenna coil;

a first core on which the antenna coil is wound;

a conductive inner core electrically connected to one end of the antenna coil to supply a high frequency signal to the antenna coil;

a second core through which the conductive inner core penetrates and of which the surface is insulated from the conductive inner core; and at least one grounding coil wound on the second core to receive a ground voltage.

10. An antenna of a mobile terminal, comprising:

an antenna coil;

a conductive inner core electrically connected to one end of the antenna coil to supply a high frequency signal to the antenna coil;

a core through which the conductive inner core penetrates;

a grounding surface formed on the surface of the core to receive a ground voltage;

at least one grounding coil connected to the grounding surface, and wherein one end of the at least one grounding coil is connected to the grounding surface.

* * * * *